US007555434B2

(12) United States Patent
Nomura et al.

(10) Patent No.: US 7,555,434 B2
(45) Date of Patent: Jun. 30, 2009

(54) AUDIO DECODING DEVICE, DECODING METHOD, AND PROGRAM

(75) Inventors: Toshiyuki Nomura, Tokyo (JP); Osamu Shimada, Tokyo (JP); Yuichiro Takamizawa, Tokyo (JP); Masahiro Serizawa, Tokyo (JP); Naoya Tanaka, Osaka (JP); Mineo Tsushima, Osaka (JP); Takeshi Norimatsu, Hyogo (JP); Kok Seng Chong, Singapore (SG); Kim Hann Kuah, Singapore (SG); Sua Hong Neo, Singapore (SG)

(73) Assignees: NEC Corporation (JP); Panasonic Corporation (JP)

( * ) Notice: Subject to any disclaimer, the term of this patent is extended or adjusted under 35 U.S.C. 154(b) by 822 days.

(21) Appl. No.: 10/485,616

(22) PCT Filed: Jun. 24, 2003

(86) PCT No.: PCT/JP03/07962

§ 371 (c)(1),
(2), (4) Date: Jan. 30, 2004

(87) PCT Pub. No.: WO2004/010415

PCT Pub. Date: Jan. 29, 2004

(65) Prior Publication Data

US 2005/0171785 A1 Aug. 4, 2005

(30) Foreign Application Priority Data

Jul. 19, 2002 (JP) ..... 2002-210945
Sep. 19, 2002 (JP) ..... 2002-273010

(51) Int. Cl.
*G10L 19/00* (2006.01)

(52) U.S. Cl. ..... 704/500; 704/501; 704/503

(58) Field of Classification Search ..... 704/500–504, 704/219, 205, 264, 200, 216, 224, 220; 708/206, 708/228
See application file for complete search history.

(56) References Cited

U.S. PATENT DOCUMENTS 5,978,759 A 11/1999 Tsushima et al.

(Continued)

FOREIGN PATENT DOCUMENTS

CA 2489443 12/2003

(Continued)

OTHER PUBLICATIONS

"A method of generation of wideband speech from band-limited speech by LPC."; Hara, et al; Mar. 1997; pp. 277-278.

(Continued)

*Primary Examiner*—Huyen X. Vo
(74) *Attorney, Agent, or Firm*—Dickstein, Shapiro, LLP.

(57) ABSTRACT

An energy corrector (105) for correcting a target energy for high-frequency components and a corrective coefficient calculator (106) for calculating an energy corrective coefficient from low-frequency subband signals are newly provided. These processors perform a process for correcting a target energy that is required when a band expanding process is performed on a real number only. Thus, a real subband combining filter and a real band expander which require a smaller amount of calculations can be used instead of a complex subband combining filter and a complex band expander, while maintaining a high sound-quality level, and the required amount of calculations and the apparatus scale can be reduced.

21 Claims, 8 Drawing Sheets

U.S. PATENT DOCUMENTS

| | | | | |
|---|---|---|---|---|
| 6,615,169 | B1 * | 9/2003 | Vainio et al. | 704/205 |
| 6,675,144 | B1 * | 1/2004 | Tucker et al. | 704/264 |
| 2002/0087304 | A1 * | 7/2002 | Kjorling et al. | 704/219 |

FOREIGN PATENT DOCUMENTS

| | | |
|---|---|---|
| EP | 0 940 015 | 9/1999 |
| JP | 8-123495 | 5/1996 |
| JP | 9-90992 | 4/1997 |
| JP | 9-101798 | 4/1997 |
| JP | 9/127998 | 5/1997 |
| WO | WO 98/52187 | 11/1998 |
| WO | WO-9857436 | 12/1998 |
| WO | WO-0045379 | 8/2000 |
| WO | WO-03/046891 | 6/2003 |

OTHER PUBLICATIONS

"A study on Synthesis Method of Band Recovery Speech"; Tsushima, et al.; Mar. 1995; pp. 249-250.

* cited by examiner

AUDIO DECODING DEVICE, DECODING METHOD, AND PROGRAM

TECHNICAL FIELD

The present invention relates to an audio decoding apparatus and decoding method for decoding a coded audio signal.

BACKGROUND ART

MPEG-2 AAC (Advanced Audio Coding) which is an international standard process of ISO/IEC is widely known as an audio coding/decoding process for coding an audio signal with high sound quality at a low bit rate. According to conventional audio coding/decoding processes that are typified by the MPEG-2 AAC, a plurality of samples from a time-domain PCM signal are put together into a frame, which is converted into a frequency-domain signal by a mapping transform such as MDCT (Modified Discrete Cosine Transform). The frequency-domain signal is then quantized and subjected to Huffman coding to produce a bit stream. For quantizing the frequency-domain signal, in view of the hearing characteristics of the human being, the quantizing accuracy is increased for more perceptible frequency components of the frequency-domain signal and reduced for less perceptible frequency components of the frequency-domain signal, thus achieving a high sound-quality level with a limited amount of coding. For example, a bit rate of about 96 kbps according to the MPEG-2 AAC can provide the same sound-quality level (at a sampling frequency of 44.1 kHz for a stereophonic signal) as CDs.

If a stereophonic signal sampled at a sampling frequency of 44.1 kHz is coded at a lower bit rate, e.g., a bit rate of about 48 kbps, then efforts are made to maximize the subjective sound quality at the limited bit rate by not coding high-frequency components that are of less auditory importance, i.e., by setting their quantized values to zero. However, since the high-frequency components are not coded, the sound-quality level is deteriorated, and the reproduced sound is generally of muffled nature.

Attention has been drawn to the band expansion technology for solving the problem of the sound quality deterioration at low bit rates. According to the band expansion technology, a high-frequency bit stream as auxiliary information in a slight amount of coding (generally several kbps) is added to a low-frequency bit stream representative of an audio signal that has been coded at a low bit rate by a coding process such as the MPEG-2 AAC process or the like, thus producing a combined bit stream. The combined bit stream is decoded by an audio decoder as follows: The audio decoder decodes the low-frequency bit stream according to a decoding process such as the MPEG-2 AAC process or the like, producing a low-frequency audio signal that is free of high-frequency components. The audio decoder then processes the low-frequency audio signal based on the auxiliary information represented by the high-frequency bit stream according to the band expansion technology, thus generating high-frequency components. The high-frequency components thus generated and the low-frequency audio signal produced by decoding the low-frequency bit stream are combined into a decoded audio signal that contains the high-frequency components.

One example of a conventional audio decoder based on the band expansion technology is a combination of an MPEG-2 AAC decoder and a band expansion technology called SBR as described in document 1, section 5.6 shown below. FIG. 1 of the accompanying drawings illustrates a conventional audio decoder based on the band expansion technology described in document 1.

Document 1: "Digital Radio Mondiale (DRM); System Specification" (ETSI TS 101 980V1. 1.1), published September, 2001, p. 42-57.

The conventional audio decoder shown in FIG. 1 comprises bit stream separator 100, low-frequency decoder 101, subband divider 402, complex band expander 403, and complex subband combiner 404.

Bit stream separator 100 separates an input bit stream and outputs separated bit streams to low-frequency decoder 101 and complex band expander 403. Specifically, the input bit stream comprises a multiplexed combination of a low-frequency bit stream representing a low-frequency signal that has been coded by a coding process such as the MPEG-2 AAC process and a high-frequency bit stream including information that is required for complex band expander 403 to generate a high-frequency signal. The low-frequency bit stream is output to low-frequency decoder 101, and the high-frequency bit stream is output to complex band expander 403.

Low-frequency decoder 101 decodes the input low-frequency bit stream into a low-frequency audio signal, and outputs the low-frequency audio signal to subband divider 402. Low-frequency decoder 101 decodes the input low-frequency bit stream according to an existing audio decoding process such as the MPEG-2 AAC process or the like.

Subband divider 402 has a complex subband dividing filter that divides the input low-frequency bit stream into a plurality of low-frequency subband signals in respective frequency bands, which are output to complex band expander 403 and complex subband combiner 404. The complex subband dividing filter may comprise a 32-band complex QMF (Quadrature Mirror Filter) bank which has heretofore been widely known in the art. The complex low-frequency subband signals divided in the respective 32 subbands are output to complex band expander 403 and complex subband combiner 404. The 32-band complex QMF bank processes the input low-frequency bit stream according to the following equation:

$$X_k(m) = \sum_{n=-\infty}^{\infty} h(mM - n)\, x(n)\, W_{K1}^{-(k+k_0)(n+n_0)}, \qquad 402.1$$

$$k = 0, 1, \ldots, K1 - 1$$

$$W_{K1} = e^{j\frac{2\pi}{K1}} \qquad 402.2$$

where x(n) represents the low-frequency audio signal, Xk(m) the kth-band low-frequency subband signal, and h(n) the analytic low-pass filter. In this example, K1=64.

Complex band expander 403 generates a high-frequency subband signal representing a high-frequency audio signal from the high-frequency bit stream and the low-frequency subband signals that have been input thereto, and outputs the generated high-frequency subband signal to complex subband combiner 404. As shown in FIG. 2 of the accompanying drawings, complex band expander 403 comprises complex high-frequency generator 500 and complex amplitude adjuster 501. Complex band expander 403 is supplied with the high-frequency bit stream from input terminal 502 and with the low-frequency subband signals from input terminal 504, and outputs the high-frequency subband signal from output terminal 503.

Complex high-frequency generator 500 is supplied with the low-frequency subband signals and the high-frequency bit stream, and copies the signal in the subband that is specified among the low-frequency subband signals by the high-frequency bit stream, to a high-frequency subband. When copying the signal, complex high-frequency generator 500 may perform a signal processing process specified by the high-frequency bit stream. For example, it is assumed that there are 64 subbands ranging from subband 0 to subband 63 in the ascending order of frequencies, and complex subband signals from subband 0 to subband 19, of those 64 subbands, are supplied as the low-frequency subband signals to input terminal 504. It is also assumed that the high-frequency bit stream contains copying information indicative of which one of the low-frequency subbands (subband 0 to subband 19) a signal is to be copied from to generate a subband A (A>19), and signal processing information representing a signal processing process (selected from a plurality of processes including a filtering process) to be performed on the signal. In complex high-frequency generator 500, a complex-valued signal in a high-frequency subband (referred to as "copied/processed subband signal") is identical to a complex-valued signal in a low-frequency subband indicated by the copying information. If the signal processing information indicates any signal processing need for better sound quality, then complex high-frequency generator 500 performs the signal processing process indicated by the signal processing information on the copied/processed subband signal. The copied/processed subband signal thus generated is output to complex amplitude adjuster 501.

One example of signal processing performed by complex high-frequency generator 500 is a linear predictive inverse filter that is generally well known for audio coding. Generally, it is known that the filter coefficients of a linear predictive inverse filter can be calculated by linearly predicting an input signal, and the linear predictive inverse filter using the filter coefficients operate to whiten the spectral characteristics of the input signal. The reason why the linear predictive inverse filter is used for signal processing is to make the spectral characteristics of the high-frequency subband signal flatter than the spectral characteristics of the low-frequency subband signal from which it is copied. A comparison between the spectral characteristics of low- and high-frequency subband signals of an audio signal, for example, indicates that the spectral characteristics of the high-frequency subband signal are often flatter than the spectral characteristics of the low-frequency subband signal. Therefore, a high-quality band expansion technology can be realized by using the above flattening technique.

Complex amplitude adjuster 501 performs a correction specified by the high-frequency bit stream on the amplitude of the input copied/processed subband signal, generating a high-frequency subband signal. Specifically, complex amplitude adjuster 501 performs an amplitude correction on the copied/processed subband signal in order to equalize the signal energy (referred to as "target energy") of high-frequency components of the input signal on the coding side and the high-frequency signal energy of the signal generated by complex band expander 403 with each other. The high-frequency bit stream contains information representative of the target energy. The generated high-frequency subband signal is output to output terminal 503. The target energy described by the high-frequency bit stream may be considered as being calculated in the unit of a frame for each subband, for example. Alternatively, in view of the characteristics in the time and frequency directions of the input signal, the target energy may be calculated in the unit of a time divided from a frame with respect to the time direction and in the unit of a band made up of a plurality of subbands with respect to the frequency direction. If the target energy is calculated in the unit of a time divided from a frame with respect to the time direction, then time-dependent changes in the energy can be expressed in further detail. If the target energy is calculated in the unit of a band made up of a plurality of subbands with respect to the frequency direction, then the number of bits required to code the target energy can be reduced. The unit of divisions in the time and frequency directions used for calculating the target energy is represented by a time frequency grid, and its information is described by the high-frequency bit stream.

According to another arrangement of complex amplitude adjuster 501, an additional signal is added to the copied/processed subband signal, generating a high-frequency subband signal. The amplitude of the copied/processed subband signal and the amplitude of the additional signal are adjusted such that the energy of the high-frequency subband signal serves as a target energy. An example of the additional signal is a noise signal or a tone signal. Gains for adjusting the amplitudes of the copied/processed subband signal and the additional signal, on the assumption that either one of the copied/processed subband signal and the additional signal serves as a main component of the generated high-frequency subband signal, and the other as an auxiliary component thereof, are calculated as follows: If the copied/processed subband signal serves as a main component of the generated high-frequency subband signal, then $$Gmain=\mathrm{sqrt}(R/E/(1+Q))$$

$$Gsub=\mathrm{sqrt}(R\times Q/N/(1+Q))$$

where Gmain represents the gain for adjusting the amplitude of the main component, Gsub the gain for adjusting the amplitude of the auxiliary component, and E, N the respective energies of the copied/processed subband signal and the additional signal. If the energy of the additional signal is normalized to 1, then N=1. In the above equations, R represents the target energy, Q the ratio of the energies of the main and auxiliary components, R, Q being described by the high-frequency bit stream, and sqrt( ) the square root. If the additional signal serves as a main component of the generated high-frequency subband signal, then $$Gmain=\mathrm{sqrt}(R/N/(1+Q))$$

$$Gsub=\mathrm{sqrt}(R\times Q/E/(1+Q))$$

The high-frequency subband signal can be calculated by weighting the copied/processed subband signal and the additional signal using the amplitude adjusting gains thus calculated and adding the copied/processed subband signal and the additional signal which are thus weighted.

Operation of complex amplitude adjuster 501 for amplitude adjustment and advantages thereof will be described in detail with reference to FIG. 3. The signal phase (phase A in FIG. 3) of high-frequency components of the input signal on the coding side and the signal phase (phase B in FIG. 3) of the high-frequency subband signal derived from the low-frequency subband signal are entirely different from each other as shown in FIG. 3. However, since the amplitude of the high-frequency subband signal is adjusted such that its signal energy is equalized to the target energy, the sound quality as it is heard is prevented from being degraded. This is because the human auditory sense is more sensitive to signal energy variations than to signal phase variations.

Complex subband combiner 404 has a complex subband combining filter that combines the bands of the low-frequency subband signal and the high-frequency subband signal that have been input thereto. An audio signal generated by combining the bands is output from the audio decoder. The complex subband combining filter that is used corresponds to the complex subband dividing filter used in subband divider 402. That is, these filters are selected such that a certain signal is divided by a complex subband dividing filter into subband signals, which are combined by a complex subband combining filter to fully reconstruct the original signal (the signal input to the complex subband dividing filter). For example, if the 32-band complex QMF dividing filter bank (K1=64) represented by the equation 402.1 is used as the complex subband combining filter, then the following equation 404.1 can be employed:

$$x(n) = \sum_{m=-\infty}^{\infty} f(n-mM)\frac{1}{K2}\sum_{k=0}^{K2-1} X_k(m)W_{K2}^{(k+k_0)(n+n_0)} \qquad 404.1$$

where f(n) represents the combining low-pass filter. In this example, K2=64.

If the sampling frequency for the audio signal output from complex subband combiner 404 is higher than the sampling frequency for the audio signal output from low-frequency decoder 101 according to the band expansion technology, then the filters are selected such that a low-frequency part (down-sampled result) of the audio signal output from complex subband combiner 404 is equal to the audio signal output from low-frequency decoder 101. Complex subband combiner 404 may employ a 64-band complex QMF combining filter bank (K2=128 in the equation 404.1). In this case, the lower-frequency 32 bands employ the output of a 32-band complex QMF combining filter bank as a signal value.

The conventional audio decoder has been problematic in that it has a subband divider and a complex subband combiner which require a large amount of calculations, and the required amount of calculations and the apparatus scale are large because the band expansion process is carried out using complex numbers.

DISCLOSURE OF THE INVENTION

It is an object of the present invention to provide a band expansion technique for maintaining high sound quality and reducing an amount of calculations required, and an audio decoding apparatus, an audio decoding method, and an audio decoding program which employ such a band expansion technique.

To achieve the above object, an audio decoding apparatus according to the present invention comprises:

a bit stream separator for separating a bit stream into a low-frequency bit stream and a high-frequency bit stream;

a low-frequency decoder for decoding the low-frequency bit stream to generate a low-frequency audio signal;

a subband divider for dividing the low-frequency audio signal into a plurality of complex-valued signals in respective frequency bands to generate low-frequency subband signals;

a corrective coefficient extractor for calculating an energy corrective coefficient based on the low-frequency subband signals;

an energy corrector for correcting a target energy described by the high-frequency bit stream with the energy corrective coefficient to calculate a corrected target energy;

a band expander for generating a high-frequency subband signal by correcting, in amplitude, the signal energy of a signal which is generated by copying and processing the low-frequency subband signals as instructed by the high-frequency bit stream, at the corrected target energy; and a subband combiner for combining the bands of the low-frequency subband signals and a real part of the high-frequency subband signal with each other with a subband combining filter to produce a decoded audio signal.

In another audio decoding apparatus according to the present invention, the corrective coefficient extractor may calculate the signal phase of the low-frequency subband signals and may calculate the energy corrective coefficient based on the signal phase. Alternatively, the corrective coefficient extractor may calculate the ratio of the energy of a real part of the low-frequency subband signals and the signal energy of the low-frequency subband signals as the energy corrective coefficient. Further alternatively, the corrective coefficient extractor may average the phases of samples of the low-frequency subband signals to calculate the energy corrective coefficient. Still further alternatively, the corrective coefficient extractor may smooth energy corrective coefficients calculated respectively in the frequency bands.

Still another audio decoding apparatus according to the present invention comprises:

a bit stream separator for separating a bit stream into a low-frequency bit stream and a high-frequency bit stream;

a low-frequency decoder for decoding the low-frequency bit stream to generate a low-frequency audio signal;

a subband divider for dividing the low-frequency audio signal into a plurality of real-valued signals in respective frequency bands to generate low-frequency subband signals;

a corrective coefficient generator for generating a predetermined energy corrective coefficient;

an energy corrector for correcting a target energy described by the high-frequency bit stream with the energy corrective coefficient to calculate a corrected target energy;

a band expander for generating a high-frequency subband signal by correcting, in amplitude, the signal energy of a signal which is generated by copying and processing the low-frequency subband signals as instructed by the high-frequency bit stream, at the corrected target energy; and a subband combiner for combining the bands of the low-frequency subband signals and a real part of the high-frequency subband signal with each other with a subband combining filter to produce a decoded audio signal.

In yet another audio decoding apparatus, the corrective coefficient generator may generate a random number and may use the random number as the energy corrective coefficient. Alternatively, the corrective coefficient generator may generate predetermined energy corrective coefficients respectively in the frequency bands.

The audio decoding apparatus according to the present invention resides in that it has an energy corrector for correcting a target energy for high-frequency components and a corrective coefficient calculator for calculating an energy corrective coefficient from low-frequency subband signals or a corrective coefficient generator for generating an energy corrective coefficient according to a predetermined process. These processors perform a process for correcting a target energy that is required when a band expanding process is performed on a real number only. Thus, a real subband combining filter and a real band expander which require a smaller amount of calculations can be used instead of a complex subband combining filter and a complex band expander, while maintaining a high sound-quality level, and the required amount of calculations and the apparatus scale can be reduced. If the corrective coefficient generator for generating an energy corrective coefficient without using low-frequency subband signals is employed, then a real subband dividing filter which requires a small amount of calculations can be used in addition to the subband combining filter and the band expander, further reducing the required amount of calculations and the apparatus scale.

BEST MODE FOR CARRYING OUT THE INVENTION

Embodiments of the present invention will be described in detail below with reference to the drawings.

1st Embodiment

Figure 6:
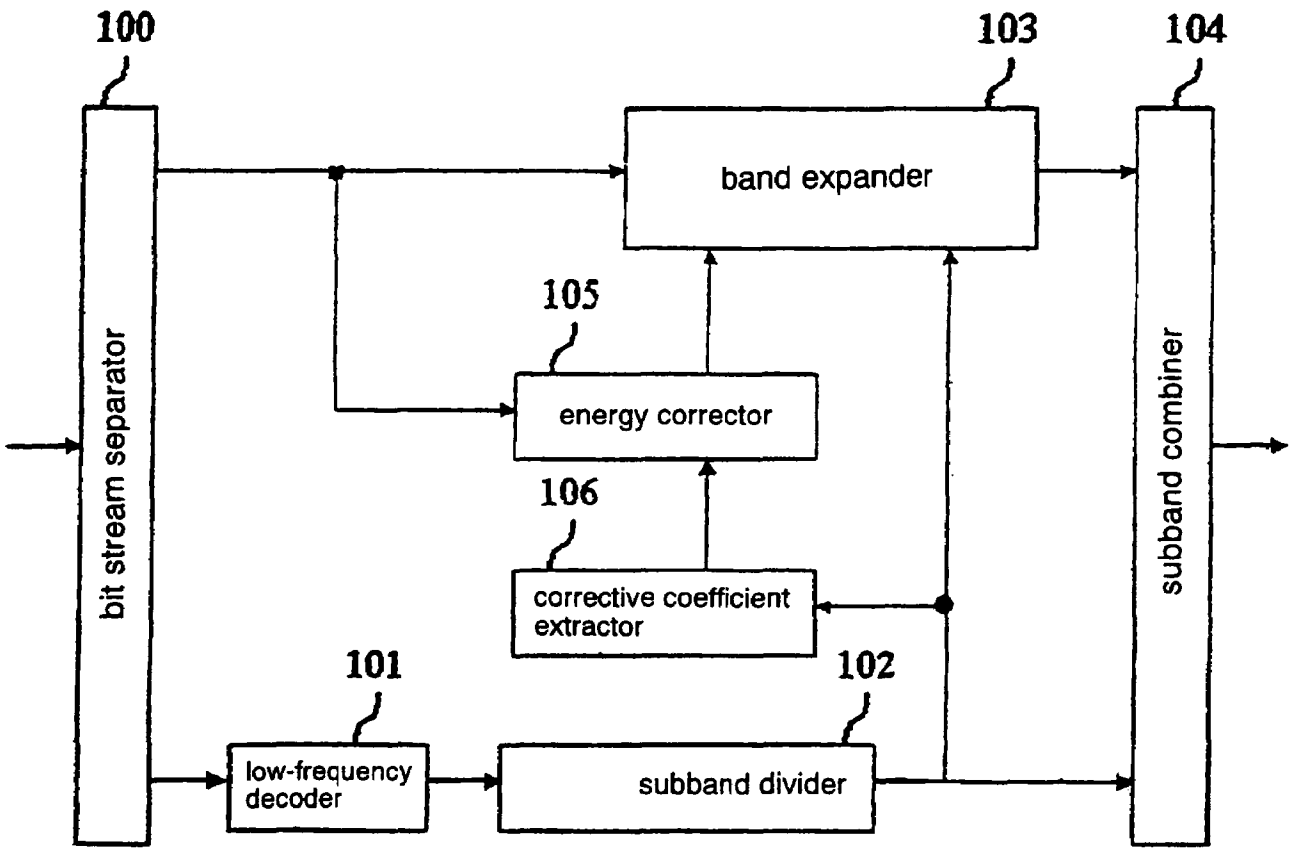
FIG. 6 is a block diagram of an audio decoding apparatus according to a first embodiment of the present invention.

FIG. 6 is a block diagram of an audio decoding apparatus according to a first embodiment of the present invention. The audio decoding apparatus according to the present embodiment comprises bit stream separator 100, low-frequency decoder 101, subband divider 102, band expander 103, subband combiner 104, energy corrector 105, and corrective coefficient extractor 106.

Bit stream separator 100 separates an input bit stream and outputs separated bit streams to low-frequency decoder 101, band expander 103, and energy corrector 105. Specifically, the input bit stream comprises a multiplexed combination of a low-frequency bit stream representing a low-frequency signal that has been coded and a high-frequency bit stream including information that is required for band expander 103 to generate a high-frequency signal. The low-frequency bit stream is output to low-frequency decoder 101, and the high-frequency bit stream is output to band expander 103 and energy corrector 105.

Low-frequency decoder 101 decodes the input low-frequency bit stream into a low-frequency audio signal, and outputs the low-frequency audio signal to subband divider 102. Low-frequency decoder 101 decodes the input low-frequency bit stream according to an existing audio decoding process such as the MPEG-2 AAC process or the like.

Subband divider 102 has a complex subband dividing filter that divides the input low-frequency bit stream into a plurality of low-frequency subband signals in respective frequency bands, which are output to band expander 103, subband combiner 104, and corrective coefficient extractor 106.

Corrective coefficient extractor 106 calculates an energy corrective coefficient from the low-frequency subband signal according to a process to be described later on, and outputs the calculated energy corrective coefficient to energy corrector 105.

Energy corrector 105 corrects a target energy for high-frequency components which is described by the high-frequency bit stream that is input thereto, according to the energy corrective coefficient, thus calculating a corrected target energy, and outputs the corrected target energy to band expander 103.

Band expander 103 generates a high-frequency subband signal representing a high-frequency audio signal from the high-frequency bit stream, the low-frequency subband signal, and the corrected target energy that have been input thereto, and outputs the generated high-frequency subband signal to subband combiner 104.

Subband combiner 104 has a subband combining filter that combines the bands of the low-frequency subband signal and the high-frequency subband signal that have been input thereto. An audio signal generated by combining the bands is output from the audio decoding apparatus.

Figure 1:
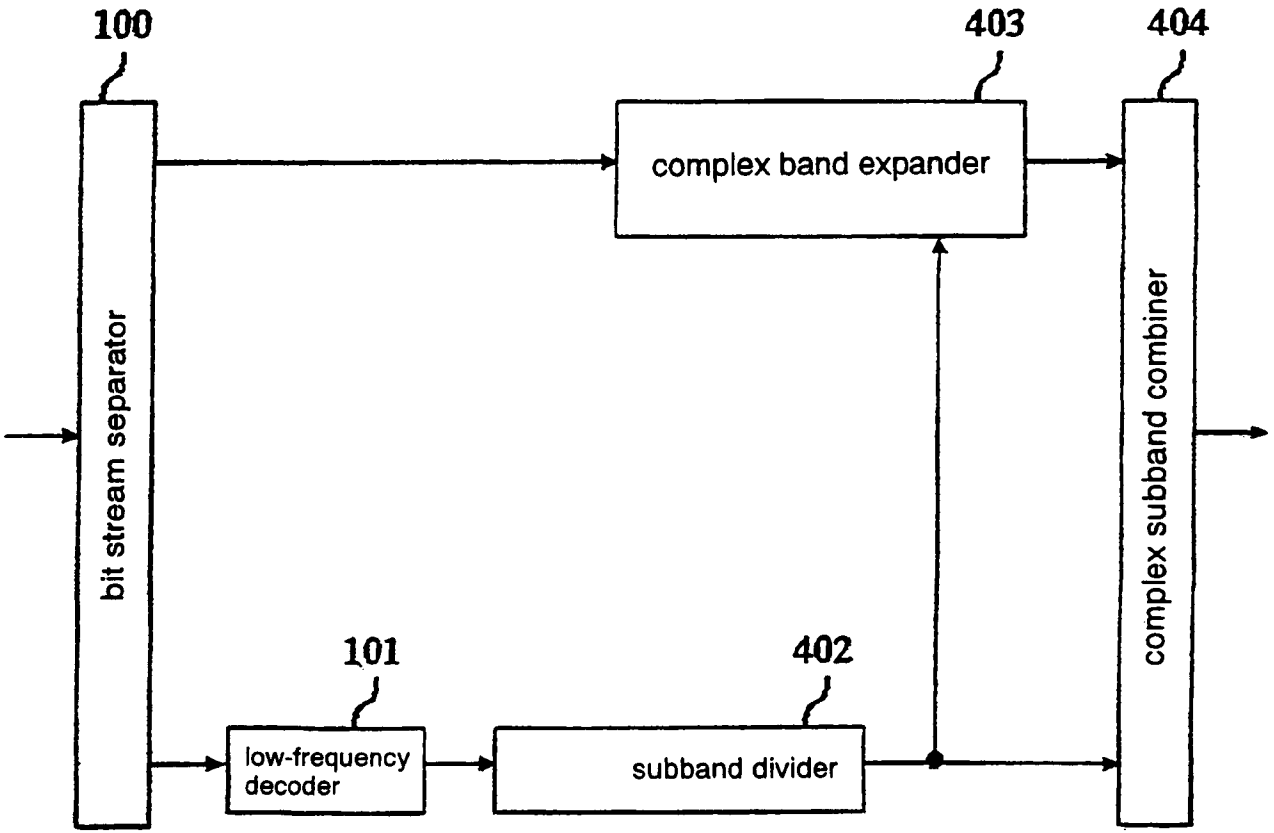
FIG. 1 is a block diagram showing an arrangement of a conventional audio decoder.
Figure 2:
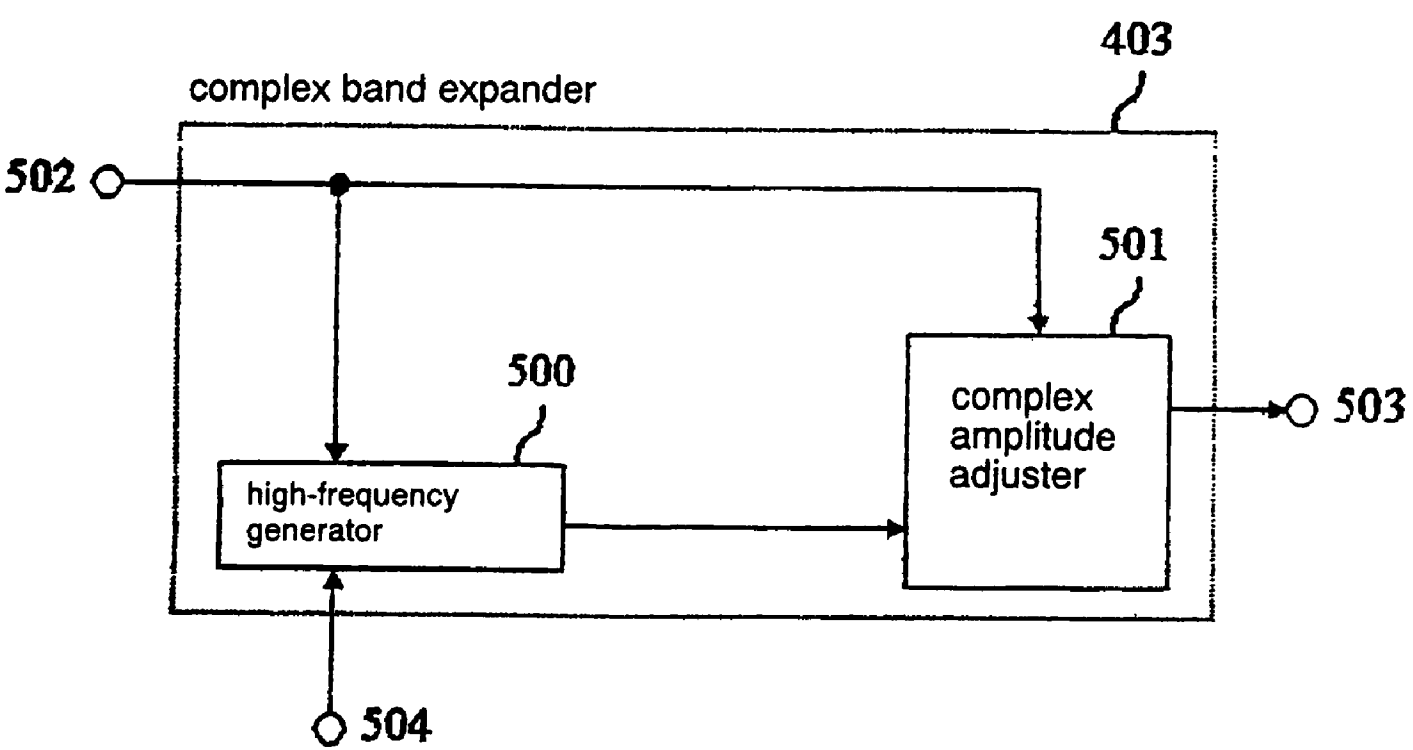
FIG. 2 is a block diagram of complex band expander 403 of the conventional audio decoder.
Figure 3:
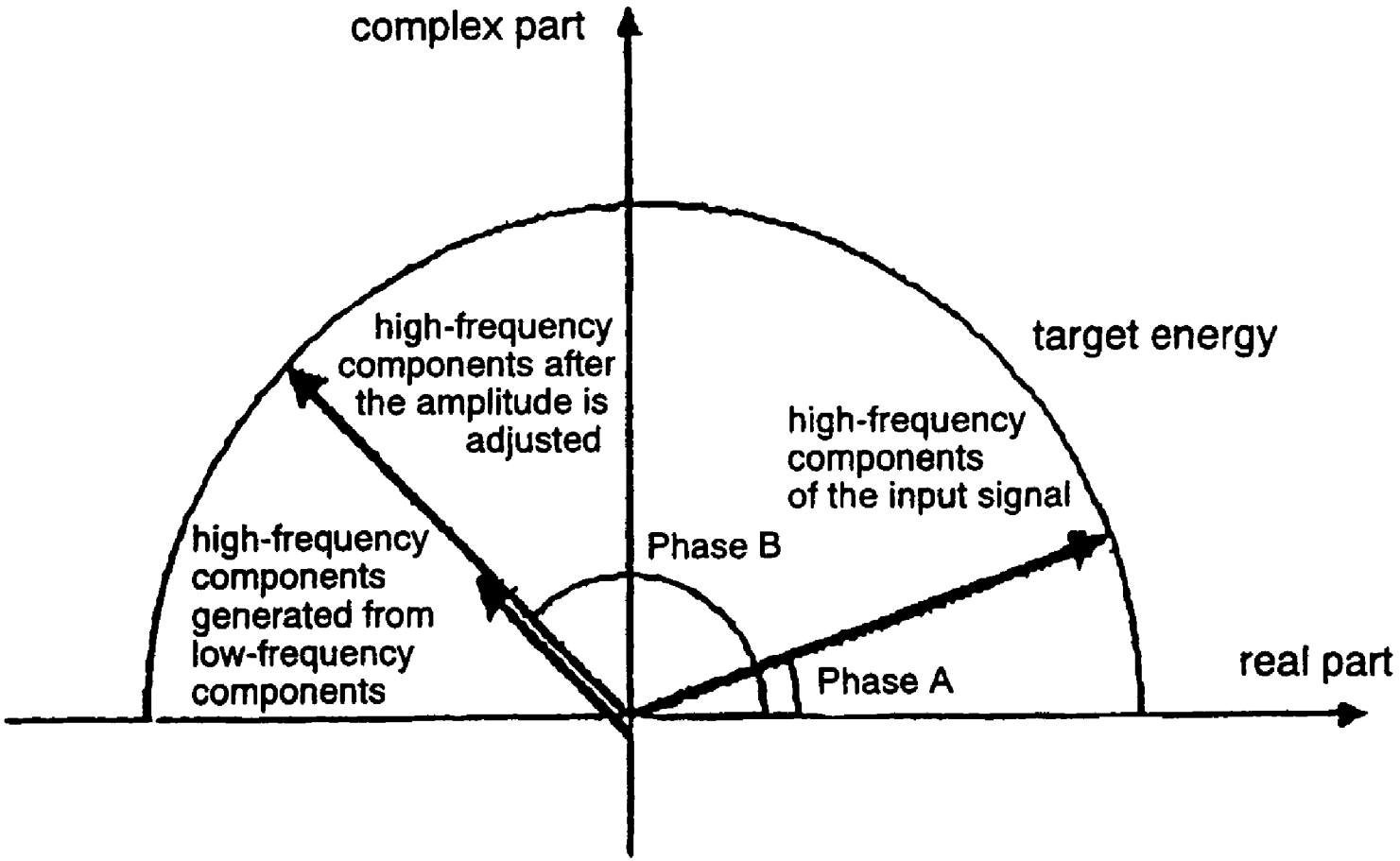
FIG. 3 is a diagram illustrative of an amplitude adjustment process according to the conventional audio decoder.

The audio decoding apparatus according to the present invention which is arranged as described above is different from the conventional audio decoder shown in FIG. 1 in that the audio decoding apparatus according to the present invention has subband divider 102 shown in FIG. 6 instead of subband divider 402 shown in FIG. 1, subband combiner 104 shown in FIG. 6 instead of subband combiner 404 shown in FIG. 1, band expander 103 shown in FIG. 6 instead of complex band expander 403 shown in FIG. 1, and additionally has corrective coefficient extractor 106 and energy corrector 105 according to the present embodiment (FIG. 6). Other processing components will not be described in detail below because they are the same as those of the conventional audio decoder, well known by those skilled in the art, and have no direct bearing on the present invention. Subband divider 102, band expander 103, subband combiner 104, energy corrector 105, and corrective coefficient extractor 106 which are different from the conventional audio decoder will be described in detail below.

First, subband divider 102 and subband combiner 104 will be described below. Heretofore, a filter bank according to the equation 402.1 for generating a complex subband signal has been used as a subband dividing filter. For a corresponding inverse conversion, a filter bank according to the equation 404.1 has been used as a subband combining filter. The output of the equation 404.1 or a signal produced by down-sampling the output of the equation 404.1 at the sampling frequency for the input signal of the equation 402.1 is fully reconstructible in full agreement with the input signal of the equation 402.1. In order to obtain a high-quality decoded audio signal, such full reconstructibility is required for the subband dividing and combining filters.

In the present embodiment, the complex subband combining filter used in conventional complex subband combiner 404 is replaced with a real subband combining filter. However, simply changing a complex subband combining filter to a real subband combining filter will lose full reconstructibility, resulting in a sound quality deterioration.

In has heretofore been well known in the art to effect rotational calculations on the output of the conventional complex subband dividing filter for achieving full reconstructibility between a complex subband combining filter and a real subband combining filter. Such rotational calculations serve to rotate the real and imaginary axes of a complex number by ($\pi \div 4$), and are the same as a well known process of deriving DCT from DFT. For example, if $k0=\frac{1}{2}$, then the following rotational calculations ($K=K1$) may be performed on each subband k for calculating the 32-band complex QMF dividing filter bank according to the equation 402.1:

$$W_K^{-(k+k_0)\frac{3}{4}K} \quad 102.1$$

In the equation 102.1, ¾K may be replaced with ¼K.

Conventional subband divider 402 with a processor for performing the rotational calculations according the equation 102.1 being added at a subsequent stage may be employed as subband divider 102. However, subband divider 102 may calculate the following equation which can achieve, with a smaller amount of calculations, a process that is equivalent to the process comprising the subband dividing filtering and the rotational calculation processing:

$$X_k(m) = \sum_{n=-\infty}^{\infty} h(mM - n)\, x(n)\, W_{K1}^{-(k+k_0)(n+n_0+\frac{3}{4}K1)}, \quad 102.2$$

$$k = 0, 1, \ldots, K1 - 1$$

The conversion represented by the equation 104.1, shown below, is effected on the equation 404.1, and the equation 104.2, shown below, representing only a real part thereof is used as a corresponding real subband combining filter in subband combiner 104. In this manner, full reconstructibility is achieved.

$$W_K^{(k+k_0)\frac{3}{4}K} \quad 104.1$$

$$x(n) = \sum_{m=-\infty}^{\infty} f(n - mM)\frac{2}{K2} \sum_{k=0}^{K2-1} \mathrm{Re}[X_k(m)]\cos\left(\frac{2\pi}{K2}(n + n_0)\left(k + k_0 + \frac{3}{4}K2\right)\right) \quad 104.2$$

where Re represents the extraction of only the real part of a complex subband signal.

Figure 8:
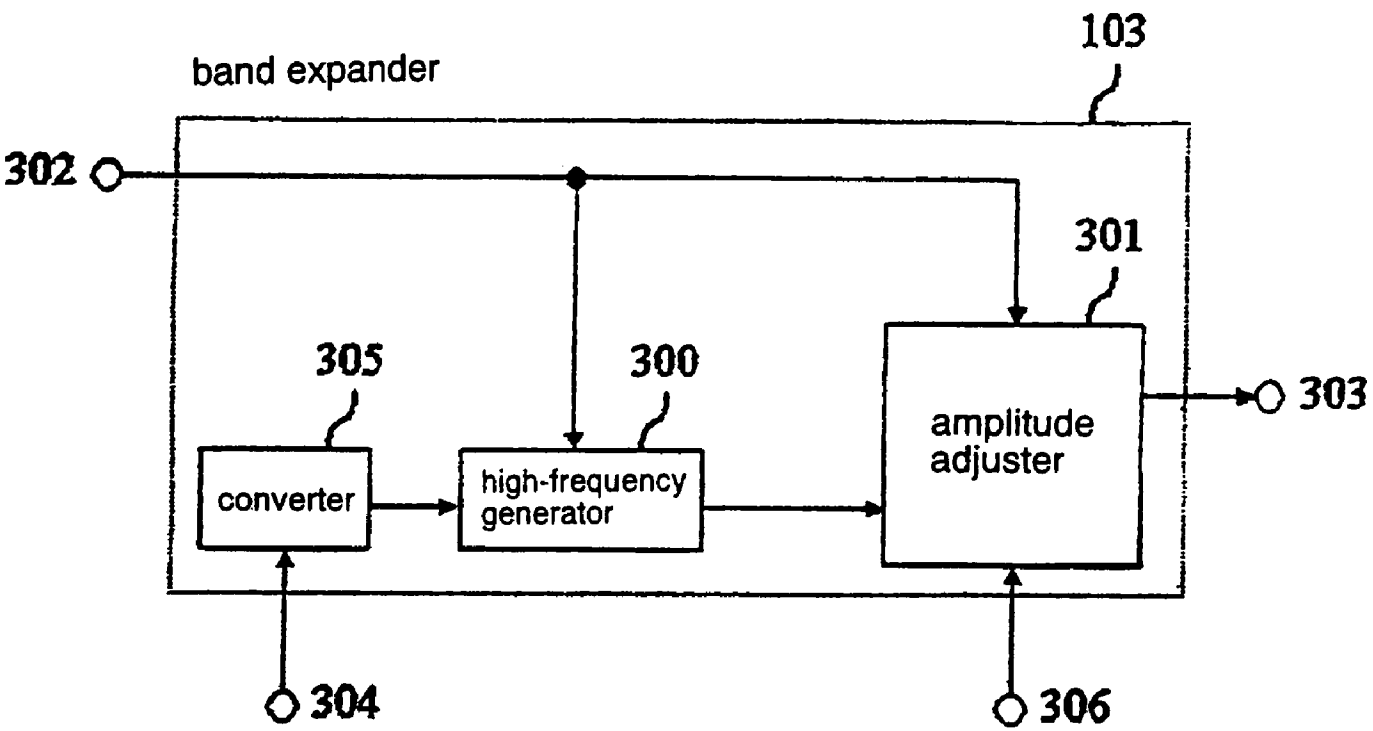
FIG. 8 is a block diagram of band expander 103 according to the present invention.

Band expander 103 will be described below. Band expander 103 generates a high-frequency subband signal representing a high-frequency audio signal from the high-frequency bit stream, the low-frequency subband signals, and the corrected target energy that have been input thereto, and outputs the generated high-frequency subband signal to subband combiner 104. As shown in FIG. 8, band expander 103 comprises high-frequency generator 300, amplitude adjuster 301, and converter 305. Band expander 103 is supplied with the high-frequency bit stream from input terminal 302, the low-frequency subband signals from input terminal 304, and the corrected target energy from input terminal 306, and outputs the high-frequency subband signal from output terminal 303.

Converter 305 extracts only the real parts from the complex low-frequency subband signals input from input terminal 304, converts the extracted real parts into real low-frequency subband signals (the low-frequency subband signals are hereafter shown in terms of a real number unless indicated otherwise), and outputs the real low-frequency subband signals to high-frequency generator 300.

High-frequency generator 300 is supplied with the low-frequency subband signals and the high-frequency bit stream, and copies the signal in the subband that is specified among the low-frequency subband signals by the high-frequency bit stream, to a high-frequency subband. When copying the signal, high-frequency generator 300 may perform a signal processing process specified by the high-frequency bit stream. For example, it is assumed that there are 64 subbands ranging from subband 0 to subband 63 in the descending order of frequencies, and real subband signals from subband 0 to subband 19, of those 64 subbands, are supplied as the low-frequency subband signals from converter 305. It is also assumed that the high-frequency bit stream contains copying information indicative of which one of the low-frequency subbands (subband 0 to subband 19) a signal is to be copied from to generate a subband A (A>19), and signal processing information representing a signal processing process (selected from a plurality of processes including a filtering process) to be performed on the signal. In high-frequency generator 300, a real-valued signal in a high-frequency subband (referred to as "copied/processed subband signal") is identical to a real-valued signal in a low-frequency subband indicated by the copying information. If the signal processing information indicates any signal processing need for better sound quality, then high-frequency generator 300 performs the signal processing process indicated by the signal processing information on the copied/processed subband signal. The copied/processed subband signal thus generated is output to amplitude adjuster 301.

One example of signal processing performed by high-frequency generator 300 is a linear predictive inverse filter as with conventional complex high-frequency generator 500. The effect of such a filter will not be described below as it is the same as with complex high-frequency generator 500. If a linear predictive inverse filter is used for a high-frequency generating process, then high-frequency generator 300 that operates with real-valued signals is advantageous in that the amount of calculations required to calculate filter coefficients is smaller than it would be with complex high-frequency generator 500 that operates with complex-valued signals.

Amplitude adjuster 301 performs a correction specified by the high-frequency bit stream on the amplitude of the input copied/processed subband signal so as to make it equivalent to the corrected target energy, generating a high-frequency subband signal. The generated high-frequency subband signal is output to output terminal 303. The target energy described by the high-frequency bit stream may be considered as being calculated in the unit of a frame for each subband, for example. Alternatively, in view of the characteristics in the time and frequency directions of the input signal, the target energy may be calculated in the unit of a time divided from a frame with respect to the time direction and in the unit of a band made up of a plurality of subbands with respect to the frequency direction. If the target energy is calculated in the unit of a time divided from a frame with respect to the time direction, then time-dependent changes in the energy can be expressed in further detail. If the target energy is calculated in the unit of a band made up of a plurality of subbands with respect to the frequency direction, then the number of bits required to code the target energy can be reduced. The unit of divisions in the time and frequency directions used for calculating the target energy is represented by a time frequency grid, and its information is described by the high-frequency bit stream.

According to another embodiment of amplitude adjuster 301, as with the conventional arrangement, an additional signal is added to the copied/processed subband signal, generating a high-frequency subband signal. The amplitude of the copied/processed subband signal and the amplitude of the additional signal are adjusted such that the energy of the high-frequency subband signal serves as a target energy. An example of the additional signal is a noise signal or a tone signal. Gains for adjusting the amplitudes of the copied/processed subband signal and the additional signal, on the assumption that either one of the copied/processed subband signal and the additional signal serves as a main component of the generated high-frequency subband signal, and the other as an auxiliary component thereof, are calculated as follows: If the copied/processed subband signal serves as a main component of the generated high-frequency subband signal, then $$Gmain=sqrt(a\times R/Er/(1+Q))$$

$$Gsub=sqrt(a\times R\times Q/Nr/(1+Q))$$

where Gmain represents the gain for adjusting the amplitude of the main component, Gsub the gain for adjusting the amplitude of the auxiliary component, and Er, Nr the respective energies of the copied/processed subband signal and the additional signal. The notations Er, Nr of the energies are different from the notations E, N in the description of the conventional arrangement in order to differentiate the real-valued signals used as the copied/processed subband signal and the additional signal according to the present invention from the complex-valued signals used as the copied/processed subband signal and the additional signal according to the conventional arrangement. If the energy of the additional signal is normalized to 1, then Nr=1. In the above equations, R represents the target energy, "a" the energy corrective coefficient that is calculated by corrective efficient extractor 106 to be described later on, with a×R representing the corrected target energy, Q the ratio of the energies of the main and auxiliary components, R, Q being described by the high-frequency bit stream, and sqrt( ) the square root. If the additional signal serves as a main component of the generated high-frequency subband signal, then $$Gmain=sqrt(a\times R/Nr/(1+Q))$$

$$Gsub=sqrt(a\times R\times Q/Er/(1+Q))$$

If the additional signal serves as a main component of the generated high-frequency subband signal, then Gmain, Gsub may be indicated by the following equations, using an energy corrective coefficient "b" calculated based on the additional signal according to the same process as with the energy corrective coefficient "a", instead of the energy corrective coefficient "a" calculated based on the complex low-frequency subband signals:

$$Gmain=sqrt(b\times R/Nr/(1+Q))$$

$$Gsub=sqrt(b\times R\times Q/Er/(1+Q))$$

If a signal stored in advance in a memory area is used as the additional signal, then the energy corrective coefficient "b" may be calculated in advance and used as a constant, so that a process for calculating the energy corrective coefficient "b" may be dispensed with. The high-frequency subband signal can be calculated by weighting the copied/processed subband signal and the additional signal using the amplitude adjusting gains thus calculated and adding the copied/processed subband signal and the additional signal which are thus weighted.

Figure 4:
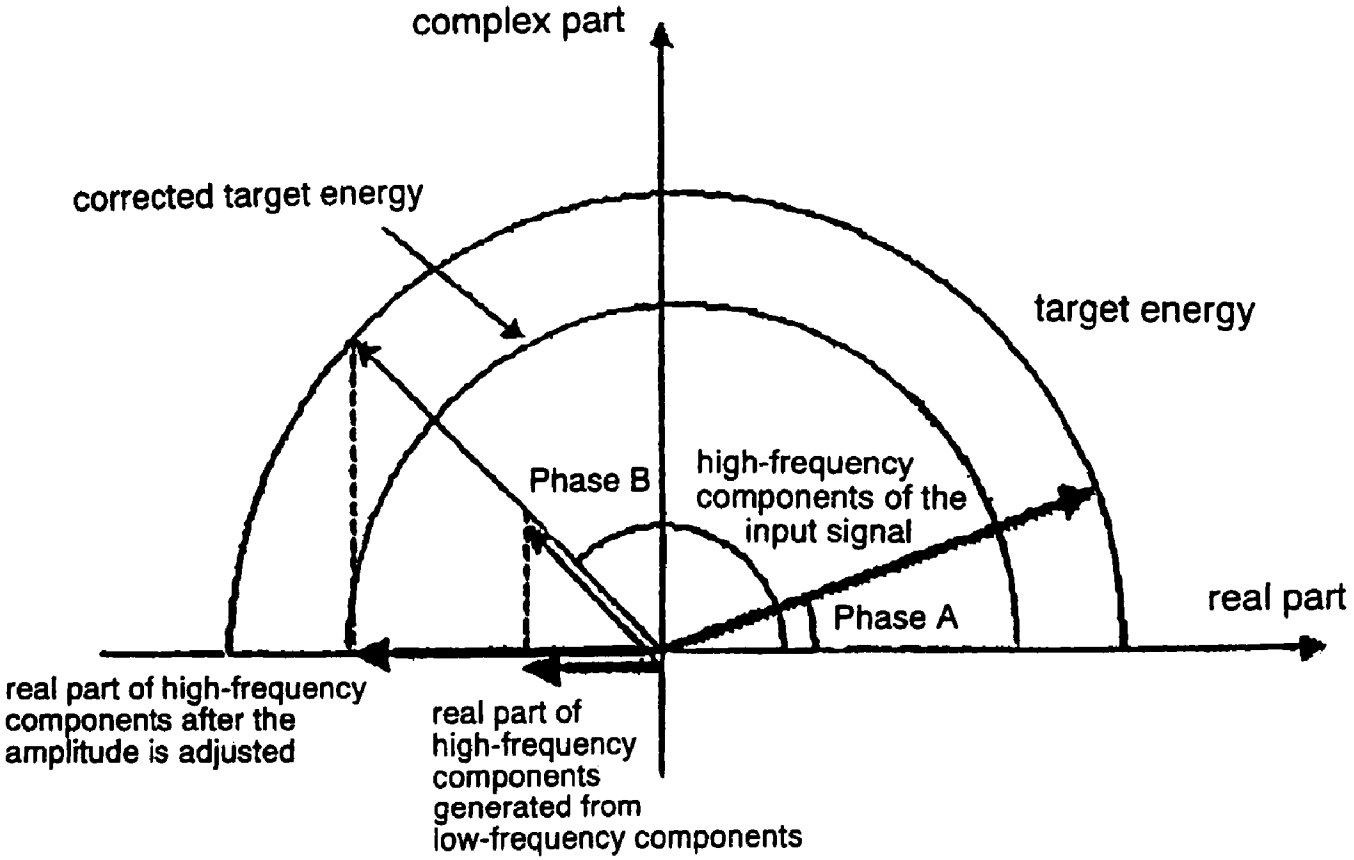
FIG. 4 is a diagram illustrative of an amplitude adjustment process according to the present invention.
Figure 5:
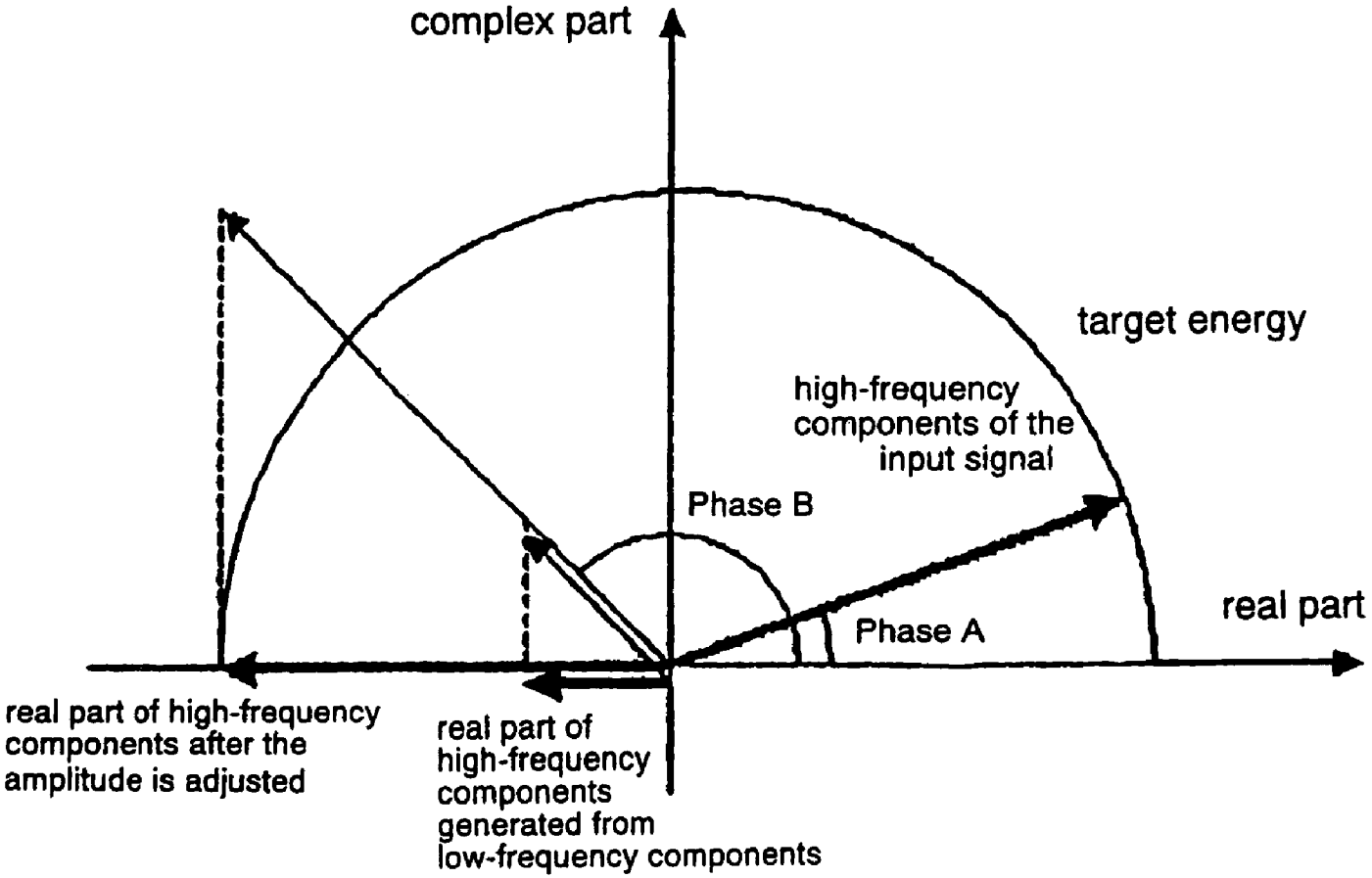
FIG. 5 is a diagram illustrative of an amplitude adjustment process without energy correction.

Operation of amplitude adjuster 301 for amplitude adjustment and advantages thereof will be described in detail with reference to FIG. 4. The amplitude of the real high-frequency subband signal (the real part of the high-frequency components whose amplitudes have been adjusted in FIG. 4) is adjusted such that its signal energy is equalized to the corrected target energy which is obtained by correcting the target energy representative of the signal energy of high-frequency components of the input signal. If the corrected target energy is calculated in view of the signal phase (phase B in FIG. 4) of the complex low-frequency subband signal before the corrected target energy is converted by converter 305, as shown in FIG. 4, then the signal energy of a hypothetical complex high-frequency subband signal derived from the complex low-frequency subband signal is equivalent to the target energy. In an analytic combining system comprising subband divider 102 and subband combiner 104 used in the present embodiment, full reconstructibility is obtained using only the real part of the subband signal, as when both the real part and the imaginary part are used. Therefore, when the amplitude of the real high-frequency subband signal is adjusted such that its signal energy is equalized to the corrected target energy, energy variations important for the human auditory sense are minimized, the sound quality as it is heard is prevented from being degraded. An example in which the amplitude is adjusted using the target energy, rather than the corrected target energy, is shown in FIG. 5. As shown in FIG. 5, if the amplitude of the real high-frequency subband signal is adjusted such that its signal energy is equalized to the corrected target energy, then the signal energy of the hypothetical complex high-frequency subband signal becomes greater than the target energy. As a result, the high-frequency components of the audio signal whose bands have been combined by subband combiner 104 are greater than the high-frequency components of the input signal on the coding side, resulting in a sound quality deterioration.

Band expander 103 has been described above. In order to realize the processing of band expander 103 only with the real part in a low amount of calculations and to obtain a high-quality decoded signal, it is necessary to employ the corrected target energy for amplitude adjustment, as described above. In the present embodiment, corrective coefficient extractor 106 and energy corrector 105 calculate the corrected target energy.

Corrective coefficient extractor 106 calculates an energy corrective coefficient based on the complex low-frequency subband signal that has been input, and outputs the calculated energy corrective coefficient to energy corrector 105. An energy corrective coefficient can be calculated by calculating the signal phase of the complex low-frequency subband signal and using the calculated signal phase as the energy corrective coefficient. For example, the energy of a low-frequency subband signal comprising complex-valued signal samples and the energy calculated from the real part thereof may be calculated, and the ratio of these energies may be used as an energy corrective coefficient. Alternatively, the phases of respective complex-valued signal sample values of a low-frequency subband signal may be calculated and averaged into an energy corrective coefficient. According to the process described above, an energy corrective coefficient is calculated for each of the divided frequency bands. The energy corrective coefficients of adjacent frequency bands and the energy corrective coefficient of a certain frequency band may be smoothed and used as the energy corrective coefficient of the certain frequency band. Alternatively, the energy corrective coefficient of a present frame may be smoothed in the time direction using a predetermined time constant and the energy corrective coefficient of a preceding frame. By thus smoothing the energy corrective coefficient, the energy corrective coefficient can be prevented from changing abruptly, with the result that the audio signal whose band has been expanded will be of increased quality.

The energy may be calculated or the phases of signal sample values may be averaged according to the above process, using signal samples contained in the time frequency grid of target energies which has been described above with respect to the conventional arrangement. In order to increase the quality of the audio signal whose band has been expanded, it is necessary to calculate an energy corrective coefficient which is accurately indicative of phase characteristics. To meet such a requirement, it is desirable to calculate an energy corrective coefficient using signal samples whose phase characteristics have small changes. Generally, the time frequency grid is established such that signal changes in the grid are small. Consequently, by calculating an energy corrective coefficient in accordance with the time frequency grid, it is possible to calculate an energy corrective coefficient which is accurately indicative of phase characteristics, with the result that the audio signal whose band has been expanded will be of increased quality. The present process may be carried out, taking into account signal changes in either one of the time direction and the frequency direction, and using signal samples included in a range that is divided by only a grid boundary in either one of the time direction and the frequency direction.

Energy corrector 105 corrects the target energy representative of the signal energy of high-frequency components of the input signal which is described by the high-frequency bit stream, with the energy corrective coefficient calculated by corrective coefficient extractor 106, thus calculating a corrected target energy, and outputs the corrected target energy to band expander 103.

2nd Embodiment

A second embodiment of the present invention will be described in detail below with reference to FIG. 7.

Figure 7:
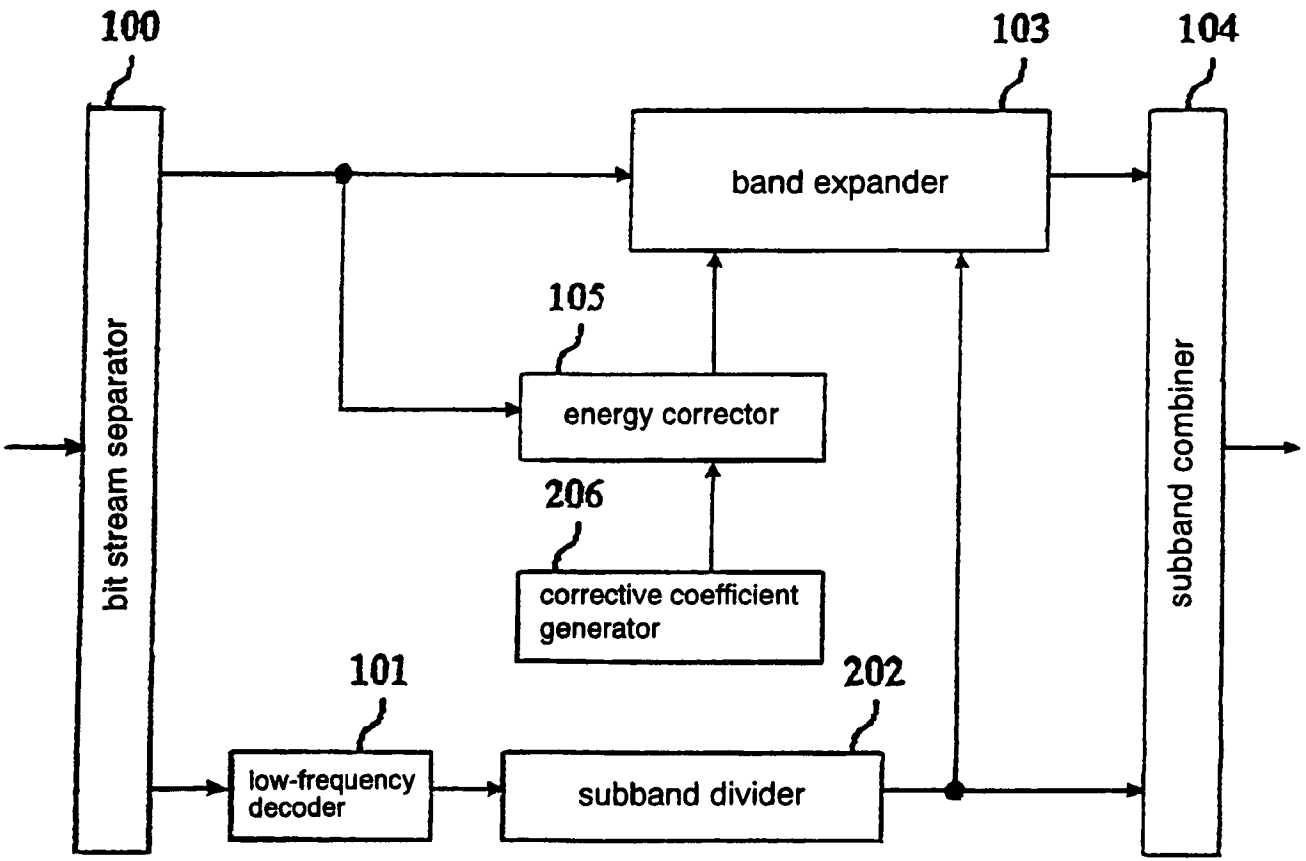
FIG. 7 is a block diagram of an audio decoding apparatus according to a second embodiment of the present invention.

FIG. 7 shows an audio decoding apparatus according to the second embodiment of the present invention. The audio decoding apparatus according to the present embodiment comprises bit stream separator 100, low-frequency decoder 101, subband divider 202, band expander 103, subband combiner 104, corrective coefficient generator 206, and energy corrector 105.

The second embodiment of the present invention differs from the first embodiment of the present invention in that subband divider 102 is replaced with subband divider 202, and corrective coefficient extractor 106 is replaced with corrective coefficient generator 206, and is exactly identical to the first embodiment as to the other components. Subband divider 202 and corrective coefficient generator 206 will be described in detail below.

Subband divider 202 has a subband dividing filter that divides the input low-frequency bit stream into a plurality of real low-frequency subband signals in respective frequency bands, which are output to band expander 103 and subband combiner 104. The subband dividing filter used by subband divider 202 is provided by only a real number processor of the equation 102.2, and has its output signal serving as a real low-frequency subband signal. Therefore, since the low-frequency subband signal input to band expander 103 is represented by a real number, converter 305 outputs the real low-frequency subband signal that is input thereto, directly to high-frequency generator 300.

Corrective coefficient generator 206 calculates an energy corrective coefficient according to a predetermined process, and outputs the calculated energy corrective coefficient to energy corrector 105. Corrective coefficient generator 206 may calculate an energy corrective coefficient by generating a random number and using the random number as an energy corrective coefficient. The generated random number is normalized to a value ranging from 0 to 1. As described above with respect to the first embodiment, if the amplitude of the real high-frequency subband signal is adjusted such that its signal energy is equalized to the target energy, then the energy of high-frequency components of the decoded audio signal becomes greater than the target energy. However, the corrected target energy can be smaller than the target energy by using an energy corrective coefficient that is derived from a random number normalized to a value ranging from 0 to 1. As a result, since the energy of high-frequency components of the decoded audio signal is not necessarily greater than the target energy, a sound quality improving capability is expected. Alternatively energy corrective coefficients may be determined in advance for respective frequency bands, and an energy corrective coefficient may be generated depending on both or one of the frequency range of a subband from which a signal is to be copied and the frequency range of a subband to which the signal is to be copied by band expander 103. In this case, each of the predetermined energy corrective coefficients is also of a value ranging from 0 to 1. According to the present process, the human auditory characteristics can be better utilized for a greater sound quality improving capability than the process which calculates an energy corrective coefficient using a random number. The above two processes may be combined to determine a maximum value for a random number in each of the frequency bands and use a random number normalized in the range as an energy corrective coefficient. Alternatively, an average value may be determined in advance in each of the frequency bands, and a random number may be generated around the average value to calculate an energy corrective coefficient. Furthermore, an energy corrective coefficient is calculated for each of the divided frequency bands, and the energy corrective coefficients of adjacent frequency bands may be smoothed and used as the energy corrective coefficient of a certain frequency band. Alternatively, the energy corrective coefficient of a present frame may be smoothed in the time direction using a predetermined time constant and the energy corrective coefficient of a preceding frame.

According to the second embodiment of the present invention, since the signal phase of the low-frequency subband signal is not taken into account, the quality of the decoded audio signal is lower than with the first embodiment of the present invention. However, the second embodiment of the present invention can further reduce the amount of calculations required because there is no need for using the complex low-frequency subband and a real subband dividing filter can be used.

The present invention is not limited to the above embodiments, but those embodiments may be modified within the scope of the technical concept of the present invention.

Although not shown, the audio decoding apparatus according to the embodiments have a recording medium that stores a program for carrying out the audio decoding method described above. The recording medium may comprise a magnetic disk, a semiconductor memory, or another recording medium. The program is read from the recording medium into the audio decoding apparatus, and controls operation of the audio decoding apparatus. Specifically, a CPU in the audio decoding apparatus is controlled by the program to instruct hardware resources of the audio decoding apparatus to perform particular processes for carrying out the above processing sequences.

The invention claimed is:

1. An audio decoding apparatus comprising:

a bit stream separator for separating a bit stream into a low-frequency bit stream and a high-frequency bit stream;

a low-frequency decoder for decoding said low-frequency bit stream to generate a low-frequency audio signal;

a subband divider for dividing said low-frequency audio signal into a plurality of real-valued signals in respective frequency bands to generate low-frequency subband signals;

an energy corrector for outputting an energy corrective coefficient for a signal which is generated by copying and processing said low-frequency subband signals;

a band expander for generating a high-frequency subband signal by correcting, in amplitude, the signal energy of the signal which is generated by copying and processing said low-frequency subband signals as instructed by said high-frequency bit stream, using said energy corrective coefficient; and a subband combiner for combining said low-frequency subband signals and said high-frequency subband signals to produce a decoded audio signal, wherein said energy corrector calculates the signal phase of said low-frequency subband signals and calculates the energy corrective coefficient based on said signal phase.

2. An audio decoding apparatus according to claim 1, wherein said energy corrector calculates the ratio of the energy of a real part of said low-frequency subband signals and the signal energy of said low-frequency subband signals as said energy corrective coefficient.

3. An audio decoding apparatus according to claim 2, wherein said energy corrector smoothes said energy corrective coefficients calculated in respective frequency bands.

4. An audio decoding apparatus according to claim 1, wherein said energy corrector calculates the averages of real part of said low-frequency subband signals to the signal energy of said low-frequency subband signals as said energy corrective coefficient.

5. An audio decoding apparatus according to 4, wherein said energy corrector smoothes said energy corrective coefficients calculated in respective frequency bands.

6. An audio decoding apparatus according to claim 1, wherein said energy corrector smoothes said energy corrective coefficients calculated in respective frequency bands.

7. An audio decoding apparatus comprising:

a bit stream separator for separating a bit stream into a low-frequency bit stream and a high-frequency bit stream;

a low-frequency decoder for decoding said low-frequency bit stream to generate a low-frequency audio signal;

a subband divider for dividing said low-frequency audio signal into a plurality of real-valued signals in respective frequency bands to generate low-frequency subband signals;

an energy corrector for outputting an energy corrective coefficient for a signal which is generated by copying and processing said low-frequency subband signals;

a band expander for generating a high-frequency subband signal by correcting, in amplitude, the signal energy of the signal which is generated by copying and processing said low-frequency subband signals as instructed by said high-frequency bit stream, using said energy corrective coefficient; and a subband combiner for combining said low-frequency subband signals and said high-frequency subband signals to produce a decoded audio signal, wherein said band expander is adapted for generating said copied subband signals by copying from said low-frequency subband signals using said high-frequency bit stream, and for generating said high-frequency subband signals by correcting, in amplitude, the signal energy (Er) of said copied subband signals by using a gain which is calculated by dividing a target energy (R) of high-frequency subband signals, described in said high-frequency bit stream by the product of said signal energy (Er) and the reciprocal (1/a) of said a predetermined energy corrective coefficient (a).

8. An audio decoding method comprising the steps of:

separating a bit stream into a low-frequency bit stream and a high-frequency bit stream;

decoding said low-frequency bit stream to generate a low-frequency audio signal;

dividing said low-frequency audio signal into a plurality of real-valued signals in respective frequency bands to generate low-frequency subband signals;

outputting an energy corrective coefficient for a signal which is generated by copying and processing said low-frequency subband signals;

generating a high-frequency subband signal by correcting, in amplitude, the signal energy of the signal which is generated by copying and processing said low-frequency subband signals as instructed by said high-frequency bit stream, using said energy corrective coefficient; and combining said low-frequency subband signals and said high-frequency subband signals to produce a decoded audio signal, wherein said outputting step calculates the signal phase of said low-frequency subband signals and calculates the energy corrective coefficient based on said signal phase.

9. An audio decoding method according to claim 8, wherein said outputting step calculates the ratio of the energy of a real part of said low-frequency subband signals and the signal energy of said low-frequency subband signals as said energy corrective coefficient.

10. An audio decoding method according to claim 9, wherein said outputting step smoothes said energy corrective coefficients calculated in respective frequency bands.

11. An audio decoding method according to claim 8, wherein said outputting step calculates the averages of real part of said low-frequency subband signals to the signal energy of said low-frequency subband signals as said energy corrective coefficient.

12. An audio decoding method according to claim 11, wherein said outputting step smoothes said energy corrective coefficients calculated in respective frequency bands.

13. An audio decoding method according to claim 8, wherein said outputting step smoothes said energy corrective coefficients calculated in respective frequency bands.

14. An audio decoding method comprising the steps of:

separating a bit stream into a low-frequency bit stream and a high-frequency bit stream;

decoding said low-frequency bit stream to generate a low-frequency audio signal;

dividing said low-frequency audio signal into a plurality of real-valued signals in respective frequency bands to generate low-frequency subband signals;

outputting an energy corrective coefficient for a signal which is generated by copying and processing said low-frequency subband signals;

generating a high-frequency subband signal by correcting, in amplitude, the signal energy of the signal which is generated by copying and processing said low-frequency subband signals as instructed by said high-frequency bit stream, using said energy corrective coefficient; and combining said low-frequency subband signals and said high-frequency subband signals to produce a decoded audio signal, wherein said generating step generates said copied subband signals by copying from said low-frequency subband signals using said high-frequency bit stream, and for generating said high-frequency subband signals by correcting, in amplitude, the signal energy (Er) of said copied subband signals by using a gain which is calculated by dividing a target energy (R) of high-frequency subband signals, described in said high-frequency bit stream by the product of said signal energy (Er) and the reciprocal (1/a) of said a predetermined energy corrective coefficient (a).

15. A computer-readable recording medium storing a program for enabling a computer to perform:

a bit stream separating process for separating a bit stream into a low-frequency bit stream and a high-frequency bit stream;

a low-frequency decoding process for decoding said low-frequency bit stream to generate a low-frequency audio signal;

a subband dividing process for dividing said low-frequency audio signal into a plurality of real-valued signals in respective frequency bands to generate low-frequency subband signals;

an energy correcting process for outputting an energy corrective coefficient for a signal which is generated by copying and processing said low-frequency subband signals;

a band expanding process for generating a high-frequency subband signal by correcting, in amplitude, the signal energy of the signal which is generated by copying and processing said low-frequency subband signals as instructed by said high-frequency bit stream, using said energy corrective coefficient; and a subband combining process for combining said low-frequency subband signals and said high-frequency subband signals to produce a decoded audio signal, wherein said energy correcting process calculates the signal phase of said low-frequency subband signals and calculates the energy corrective coefficient based on said signal phase.

16. A computer-readable recording medium according to claim 15, wherein said energy correcting process calculates the ratio of the energy of a real part of said low-frequency subband signals and the signal energy of said low-frequency subband signals as said energy corrective coefficient.

17. A computer-recording medium according to claim 16, wherein said energy correcting process smoothes said energy corrective coefficients calculated in respective frequency bands.

18. A computer-readable recording medium according to claim 15, wherein said energy correcting process calculates the averages of real part of said low-frequency subband signals to the signal energy of said low-frequency subband signals as said energy corrective coefficient.

19. A computer-readable recording medium according to claim 18, wherein said energy correcting process smoothes said energy corrective coefficients calculated in respective frequency bands.

20. A computer-readable recording medium according to claim 15, wherein said energy correcting process smoothes said energy corrective coefficients calculated in respective frequency bands.

21. A computer-readable recording medium storing a program for enabling a computer to perform:

a bit stream separating process for separating a bit stream into a low-frequency bit stream and a high-frequency bit stream;

a low-frequency decoding process for decoding said low-frequency bit stream to generate a low-frequency audio signal;

a subband dividing process for dividing said low-frequency audio signal into a plurality of real-valued signals in respective frequency bands to generate low-frequency subband signals;

an energy correcting process for outputting an energy corrective coefficient for a signal which is generated by copying and processing said low-frequency subband signals;

a band expanding process for generating a high-frequency subband signal by correcting, in amplitude, the signal energy of the signal which is generated by copying and processing said low-frequency subband signals as instructed by said high-frequency bit stream, using said energy corrective coefficient; and a subband combining process for combining said low-frequency subband signals and said high-frequency subband signals to produce a decoded audio signal, wherein said band expanding process generates said copied subband signals by copying from said low-frequency subband signals using said high-frequency bit stream, and for generating said high-frequency subband signals by correcting, in amplitude, the signal energy (Er) of said copied subband signals by using a gain which is calculated by dividing a target energy (R) of high-frequency subband signals, described in said high-frequency bit stream by the product of said signal energy (Er) and the reciprocal (1/a) of said a predetermined energy corrective coefficient (a).

* * * * *